US009366392B2

(12) United States Patent
Kusunose

(10) Patent No.: US 9,366,392 B2
(45) Date of Patent: Jun. 14, 2016

(54) STRAIGHT TUBE LED LAMP USING SEMICONDUCTOR LIGHT-EMITTING ELEMENT AND LIGHTING DEVICE INCORPORATING THE SAME

(71) Applicant: Noboru Kusunose, Kanagawa (JP)

(72) Inventor: Noboru Kusunose, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 10 days.

(21) Appl. No.: 13/911,161

(22) Filed: Jun. 6, 2013

(65) Prior Publication Data

US 2013/0329414 A1 Dec. 12, 2013

(30) Foreign Application Priority Data

Jun. 7, 2012 (JP) ..... 2012-130066

(51) Int. Cl.
*F21K 99/00* (2010.01)

(52) U.S. Cl.
CPC .. *F21K 9/17* (2013.01); *F21K 9/175* (2013.01)

(58) Field of Classification Search
CPC ..... F21K 9/17; F21K 9/175
USPC ..... 362/233
See application file for complete search history.

(56) References Cited

U.S. PATENT DOCUMENTS

2011/0273871 A1* 11/2011 Fukui ..... 362/218
2012/0300409 A1* 11/2012 Lee ..... 361/721

FOREIGN PATENT DOCUMENTS

JP 2002-334607 11/2002
JP 2011-28946 2/2011
JP 2011-113876 6/2011
JP 2011-210669 10/2011

OTHER PUBLICATIONS

Partial machine translation for IDS document JP 2011-113876.*

* cited by examiner

*Primary Examiner* — Nimeshkumar Patel
*Assistant Examiner* — Jacob R Stern
(74) *Attorney, Agent, or Firm* — Cooper & Dunham LLP

(57) ABSTRACT

A straight tube LED lamp includes a substrate on which semiconductor light-emitting elements are mounted in longitudinal direction, a long metal chassis with a semi-circular cross section, to mount the substrate in a chord portion of the semi-circle, a resin sheet interposed between the chassis and the substrate, a translucent element contacting the chassis to form a circle, made from a resin or glass through which light beams from semiconductor light-emitting elements are transmitted, cap elements to cover both ends of the chassis and the translucent element and connectable to a lamp fitting, and a power supply board on which an electronic component for AC-DC conversion to supply current to the semiconductor light-emitting elements is mounted, contained in the chassis. The resin sheet is made from different materials at least at an overlapping portion and a non-overlapping portion of the power supply board and the substrate in longitudinal direction.

3 Claims, 5 Drawing Sheets

STRAIGHT TUBE LED LAMP USING SEMICONDUCTOR LIGHT-EMITTING ELEMENT AND LIGHTING DEVICE INCORPORATING THE SAME

CROSS REFERENCE TO RELATED APPLICATION

The present application is based on and claims priority from Japanese Patent Application No. 2012-130066, filed on Jun. 7, 2012, the disclosure of which is hereby incorporated by reference in its entirety.

BACKGROUND OF THE INVENTION

1. Field of the Invention

The present invention relates to a straight tube LED lamp using a semiconductor light-emitting element as a light source and a lighting device incorporating such an LED lamp, in particular, to the heat radiation from a substrate on which the semiconductor light-emitting element is mounted and a power supply board.

2. Description of the Related Art

For the purpose of energy saving, straight tube lamps using semiconductor optical elements such as LEDs have increasingly replaced fluorescent lamps and candescent lamps. The semiconductor optical elements excel a fluorescent lamp in terms of longevity and no blinking and flickers over time.

Japanese Patent Application Publication No. 2011-28946 (Reference 1) discloses an LED lighting device which comprises a long semi-cylindrical exothermic chassis, a semi-circular translucent cover attached on a planar portion of the chassis and having almost the same outer diameter as that of the semi-cylinder of the chassis, and a long substrate closely attached to the outer face of the planar portion and on which semiconductor optical elements as LEDs are mounted with a predetermined interval along the length. It contains a power supply board and lines for the LEDs in a hollow of the chassis.

Further, Japanese Patent Application Publication No. 2011-113876 (Reference 2) discloses an LED lighting device which comprises a transparent or semi-transparent tube with an opening on a circumference, a heat sink fitting into the opening, and semiconductor optical elements as LEDs mounted inside the tube. The heat sink is of a hollow structure directly or indirectly connected to the LEDs.

Further, Japanese Patent Application Publication No. 2011-210669 (Reference 3) discloses an LED lighting device which comprises an aluminum lamp fitting and a lighting portion detachable from the lamp fitting. The lighting portion includes a long aluminum LED substrate on which semiconductor optical elements are disposed, a long aluminum base of which the LED substrate is attached to a bottom surface, and a long cover attached to the base to expose at least the top surface of the base and cover the LED substrate. The lamp fitting includes a power supply circuit connected to an external power source to light the LEDs. The top surface of the base contacts the bottom surface of the lamp fitting while the lighting portion is mounted in the lamp fitting. The LED substrate is attached onto the base by an adhesive with a thermal conductivity.

There is a problem with the LED lighting device disclosed in Reference 1 that the temperature of the sealed chassis tends to rise highly due to the power supply board and wiring contained in the chassis. Especially, the parts such as a condenser and a coil on the power supply board may exceed 120 degrees, causing a difference in temperature along the length of the chassis with or without the power supply board. The LED substrate is attached closely to the chassis on the opposite side of the power supply board. The temperature of the LEDs may exceed 90 degrees but is lower than that of the power supply board so that the heat therefrom is transferred to the substrate. Thus, there may be unevenness in the temperature of the substrate due to the heat radiation from the power supply board such that the part close to the power supply board is higher in temperature than the part away therefrom. An incidence may occur that over time some LEDs greatly affected from the heat become burned out while the rest of the LEDs are lighting in a single straight tube lamp.

In Reference 2 the LEDs are directly or indirectly connected to the heat sink for heat transfer. The LEDs are accordingly prevented from rising in temperature and receives less thermal load. However, it lacks a direct current source so that the lamp fitting needs to include an AC-DC converter to supply direct currents to the LEDs from a commercial power source or a power source supplied from a stabilizer. This requires an additional electric work and incurs extra costs. If an existing straight tube lamp as fluorescent lamp is not replaced with the LED type and remains in the lamp fitting, erroneously connecting it to the commercial power source or the power source from the stabilizer and the flow of alternating currents may cause a fire or electrification.

In Reference 3 the LED substrate having a power source is attached to the base as a heat sink by a thermal adhesive. However, since it is integrated with the lamp fitting, an electric work is needed to replace an existing fluorescent lamp with this LED straight tube lamp, incurring extra costs. Further, to replace the LED substrate, the lamp fitting has to be disassembled, taking a longer time for maintenance. The power source is contained in a housing which is greatly larger than the diameter of the straight tube LED lamp. Cooling effects by airflow are expected but this device cannot replace the fluorescent lamp.

SUMMARY OF THE INVENTION

The present invention aims to provide a straight tube LED lamp and a lighting device which can reduce unevenness in the cooling of a substrate on which a power supply board and semiconductor optical elements are mounted to improve the durability of the semiconductor optical elements, as well as can replace an existing fluorescent lamp by a simple work at low costs.

According to one embodiment of the present invention, a straight tube LED lamp includes a substrate on which semiconductor light-emitting elements are mounted in a longitudinal direction, a chassis with a semi-circular cross section, made from a metal, and extending in the longitudinal direction, to mount the substrate in a chord portion of the semicircle, a resin sheet interposed between the chassis and the substrate, a translucent element contacting the chassis to form a circle, made from a resin or glass through which light beams from semiconductor light-emitting elements are transmitted, and extending in the longitudinal direction, cap elements placed to cover both ends of the chassis and the translucent element, and connectable to a lamp fitting, a power supply board on which an electronic component is mounted, contained in the chassis, the electronic component supplied with an alternating current via terminals of the cap elements to convert the alternating current to a direct current supplied to the semiconductor light-emitting elements, in which the resin sheet is made from different materials at least at an overlapping portion of and a non-overlapping portion of the power supply board and the substrate in the longitudinal direction.

BRIEF DESCRIPTION OF THE DRAWINGS

Features, embodiments, and advantages of the present invention will become apparent from the following detailed description with reference to the accompanying drawings.

DESCRIPTION OF THE PREFERRED EMBODIMENTS

Hereinafter, embodiments of the present invention will be described in detail with reference to the accompanying drawings. Wherever possible, the same reference numbers will be used throughout the drawings to refer to the same or like parts.

Figure 1:
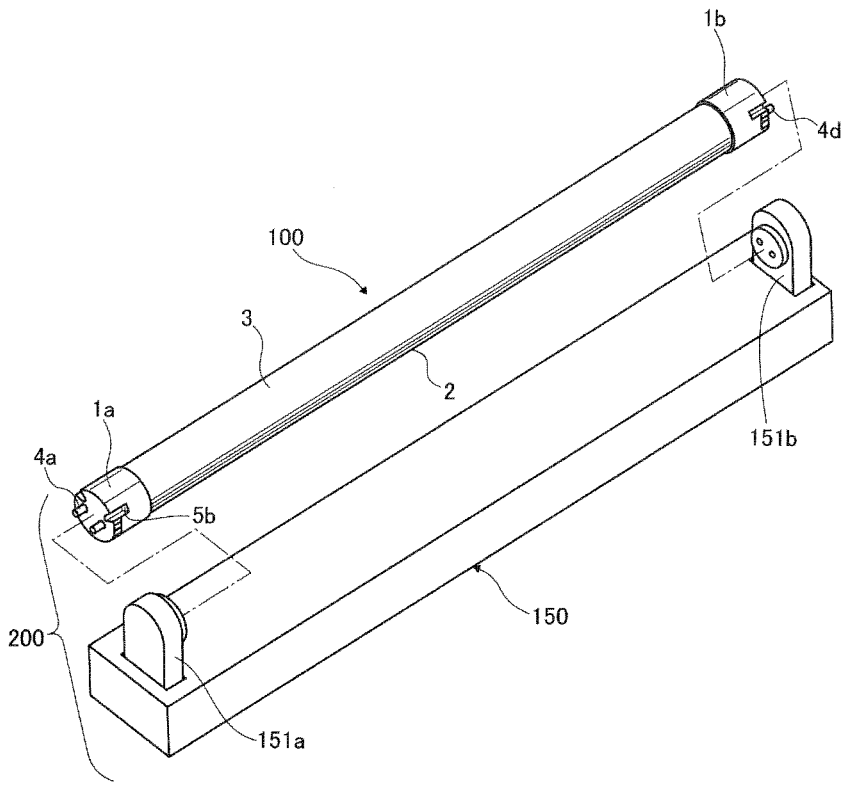
FIG. 1 is a perspective view of the exterior of a lighting device incorporating a straight tube LED lamp using semiconductor light-emitting elements and a lamp fitting according to one embodiment.
Figure 2A:
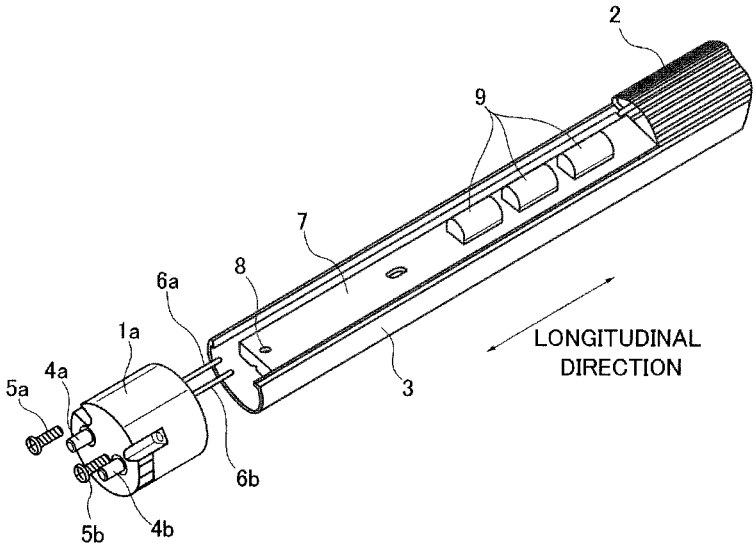
FIGS. 2A, 2B are perspective views of one and the other end of the inner structure of the straight tube LED lamp in FIG. 1, respectively.
Figure 2B:
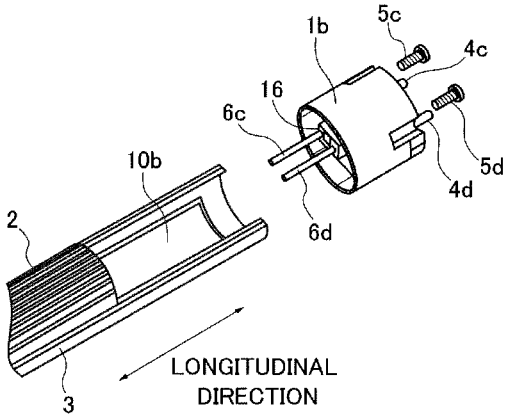

FIG. 1 is a perspective view of the exterior of a lighting device 200 according to one embodiment. The lighting device 200 comprises a straight tube LED lamp 100 and a lamp fitting 150 into which the straight tube LED lamp 100 is fitted and having sockets 151*a*, 151*b*. The straight tube LED lamp 100 is of a semi-cylindrical shape with an approximately same cross section and includes a long chassis 2 made from a metal by bending or from aluminum alloy or magnesium alloy by extrusion molding, a translucent element fitted into the chassis 3, and cap elements 1*a*, 1*b* provided at both ends of the chassis 2 and translucent element 3 to be connectable to the sockets 151*a*, 151*b* of the lamp fitting 150 and contact light beams from semiconductor light-emitting elements 12*a*, 12*b* to form a circle.

The cap elements 1*a*, 1*b* are cylindrical with a bottom and fixed with the chassis 2 by screws 4*a*, 4*b*, 4*c*, 4*d* to enclose the translucent element 3 and the chassis 2 integrally. The cap elements 1*a*, 1*b* are placed to cover both ends of the chassis 2 and the translucent element 3.

The cap elements 1*a*, 1*b* can be produced by swaging instead of the fixing by screws. The shape thereof is approximately the same as that of the caps of an existing florescent lamp, and the shape of the straight tube LED lamp 100 is similar to that of a straight tube florescent lamp and replaceable with an existing florescent lamp mounted in the lamp fitting 150.

As shown in FIG. 2A to FIG. 4, terminals 4*a*, 4*b* protrude from the cap element 1*a* while terminals 4*c*, 4*d* protrude from the cap element 1*b* along the length. The terminals 4*a* to 4*d* can be fixed to the respective cap elements by any of inserting, swaging, and screwing. Each cap element contains a connector 16 in FIGS. 2B, 3B via which an alternating current is supplied from a commercial power source or a power source supplied from a not-shown stabilizer to the straight tube LED lamp 100. The current is fed to a power supply board 7 in FIG. 2A through leads 6*a*, 6*b*, 6*c*, 6*d*.

Figure 3A:
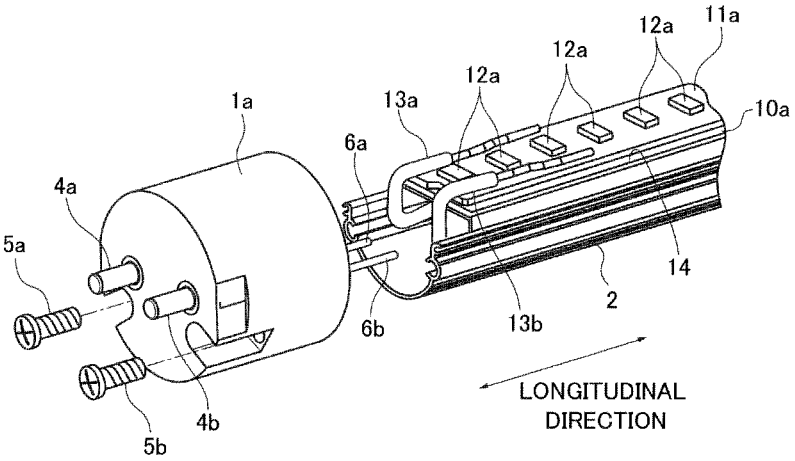
FIGS. 3A, 3B are perspective views of one and the other end of the inner structure of the straight tube LED lamp in FIG. 1 as seen from the semiconductor light-emitting elements, respectively.
Figure 3B:
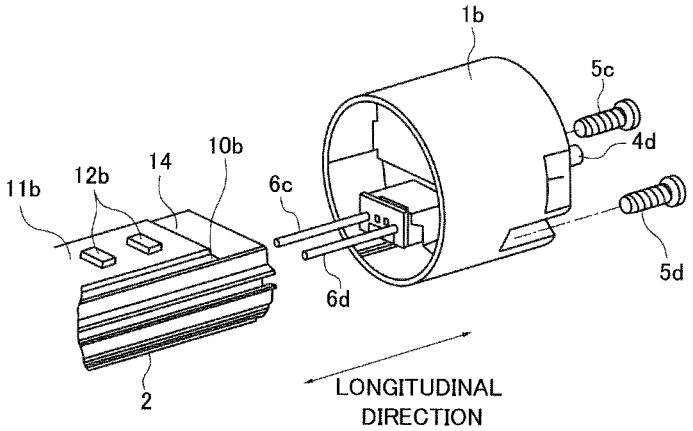
Figure 4:
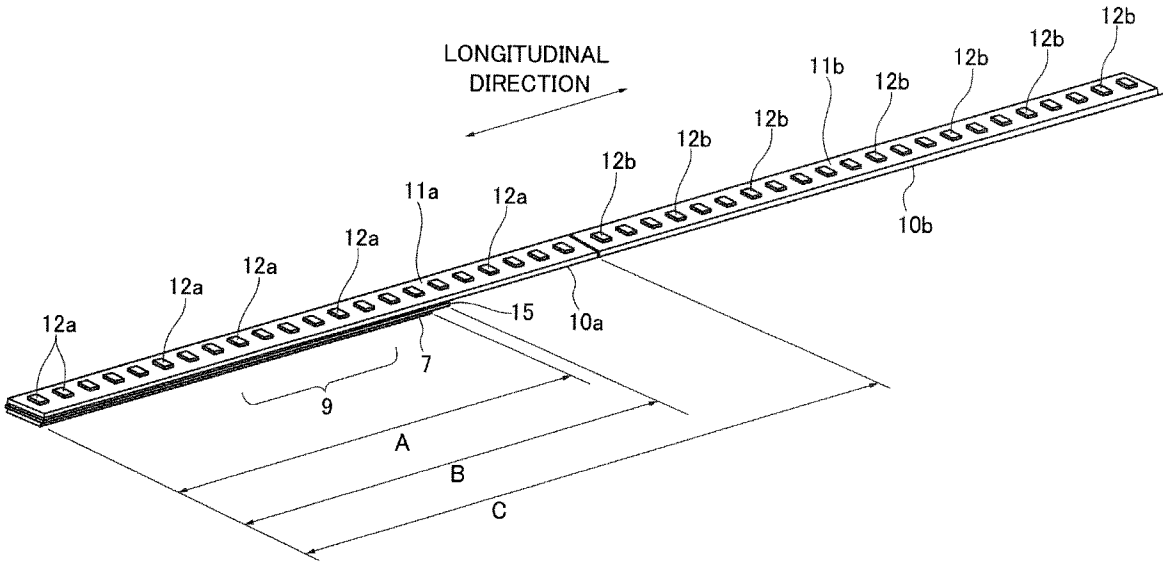
FIG. 4 shows the sizes of substrates, sheets, and a separator as insulator.

The semiconductor light-emitting elements 12*a*, 12*b* are mounted on substrate 11*a*, 11*b* along the length in FIGS. 3A, 3B, 4. Electronic components 9 are mounted on the power supply board 7 to supply a direct current to the substrate 11*a*, 11*b*, respectively. The electronic components 9 include a coil and a condenser which generate heat in converting the alternating current to the direct current and a component which exceeds a temperature of 120 degrees. In the present embodiment the power supply board is securely fixed in the semi-cylindrical chassis 2 with a not-shown screw or rivet through a hole in FIG. 2A.

The direct current converted by the electronic components 9 is supplied to the substrates 11*a*, 11*b* via leads 13*a*, 13*b*. Herein, the semiconductor light-emitting elements 12*a*, 12*b* are LEDs utilizing electroluminescence effects.

In FIG. 4 the substrates 11*a*, 11*b* are aligned in parallel along the length and electrically connected via not-shown leads or jumpers. The present embodiment exemplifies two substrates 11*a*, 11*b* on which the semiconductor light-emitting elements are mounted, however, the number thereof can be more than two and should not be limited thereto.

Thus, by placing the power supply board 7 on which the electronic components 9 for the AC-DC conversion are mounted inside the chassis 2, it is made possible to easily replace an existing fluorescent lamp in an existing lamp fitting with the straight tube LED lamp 100, eliminating the necessity for work time and costs for replacing the lamp fitting. This leads to spreading the use of the straight tube LED lamp 100 and improving power saving.

According to the present embodiment the power supply board 7 is disposed below the substrate 11*a* in FIG. 4 and no elements are placed below the substrate 11*b*. That is, there is a hollow space on the substrate 11*b* side of the chassis 2. Further, the substrate 11*a*, 11*b* are mounted on a planar portion 14 which corresponds to the chord of the semi-circle of the chassis 2. Resin sheets 10*a*, 10*b* are interposed between the planar portion 14 and the substrates 11*a*, 11*b*, respectively.

According to the present embodiment the length A of the power supply board 7 and that C of the resin sheet 10*a* are set to satisfy the following relation, $A \leq C$, as shown in FIG. 4. The length C of the resin sheet 10*a* is approximately the same as that B of the substrate 11*a*.

The resin sheet 10*a* is made from a material with a low thermal conductivity and thermal insulation effects, to prevent heat transfer from the power supply board 7. The resin sheet 10*b* is made from a material with a thermal conductivity to have the semiconductor light-emitting elements 12*a*, 12*b* on the substrates 11*a*, 11*b* be saturated at similar temperatures, for example, a heat-dissipating silicone rubber with a thermal conductivity of 3.0 W/m*K or more or a PC sheet as general thermal insulator with no thermal conductivity.

The length of the resin sheet 10*b* can be set to (length A of power supply board 7)−(that C of resin sheet 10*a*) instead of the length C almost equal to the length B of the substrate 11*a* in FIG. 4. This allows the substrates 11*a*, 11*b* to rise in temperature in the same manner and prevents only a part of the semiconductor light-emitting elements 12*a* on the substrate 11*a* from increasing in temperature. The resin sheets 10*a*, 10*b* can be made from an electrically insulating material.

Figure 5:
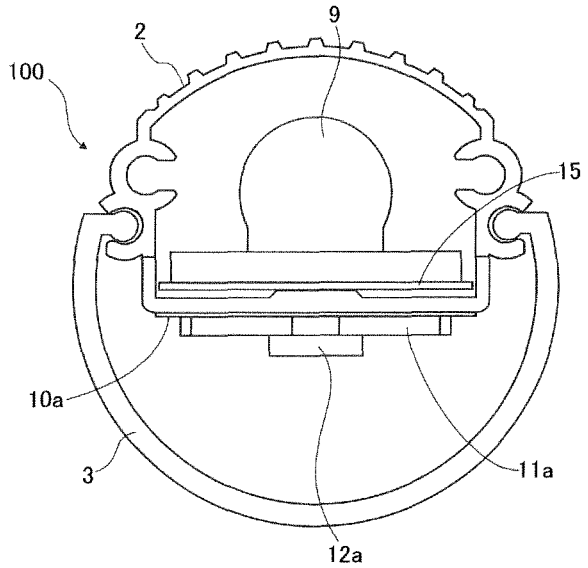
FIG. 5 shows one end of the straight tube LED lamp in FIG. 1 with a cover detached.
Figure 6:
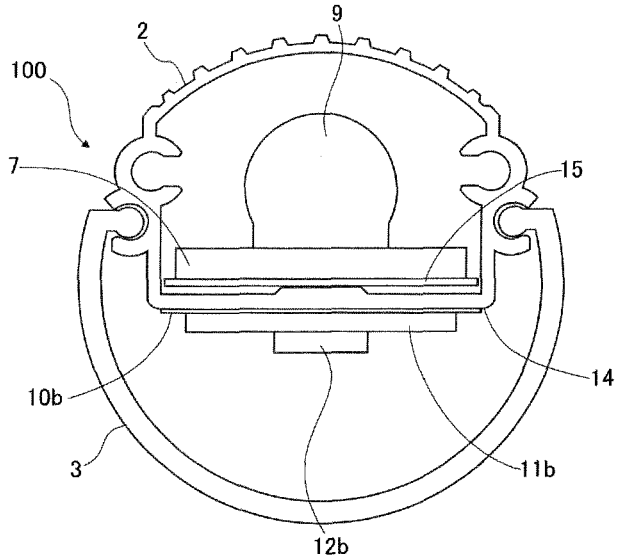
FIG. 6 shows the other end of the straight tube LED lamp in FIG. 1 with a cover detached.

The straight tube LED lamp 100 further includes a separator 15 between the chassis 2 and power supply board 7 in the chassis 2 as shown in FIGS. 5, 6. The length of the separator 15 is set to be longer than that A of the power supply board 7. The separator 15 is made from a resin or a ceramic with a low thermal conductivity. The heat from the power supply board is transferred to the chassis 2 by radiation or the air inside the chassis 2.

Thus, the heat is not directly transferred from the power supply board 7 to the chassis 2, preventing a part of the chassis 2 from being heated to a high temperature. This eliminates possibility for an operator to get hurt or burned by touching the chassis at work, resulting in an improvement in workability. Further, due to a decrease in a partial temperature deviation of the chassis 2, the temperature of the substrates 11*a*, 11*b* similarly rises so that an increase in the temperature of only a part of the semiconductor light-emitting elements 12*a* near the power supply board 7 and electronic components 9 as a heat source can be prevented.

According to the present embodiment the separator 15 between the chassis 2 and power supply board 7 and the resin sheets 10*a*, 10*b* made from a proper material can hinder the heat transfer from the power supply board 7 to the substrate 11*a* so that all the semiconductor light-emitting elements 12*a*, 12*b* are almost equally affected by the heat. Thereby, it is made possible to prevent a decrease in the longevity of semiconductor light-emitting elements close to the heat source over time, and prevent a partial heat-up of the chassis 2 which may otherwise cause an operator to get burned or hurt. Further, it is possible to reduce the thermal influence from the power supply board 7 to the substrate 11*a*.

Further, the resin sheets 10*a*, 10*b* are made from different materials at least at an overlapping portion and a non-overlapping portion between the power supply board 7 and the substrate 12 along the length. This also prevents the heat transfer from the power supply board 7 to the substrate 11*a* on which the semiconductor light-emitting elements 12*a* are mounted. Thereby, the same effects as above are also achieved.

As described above, the lighting device 200 comprises the straight tube LED lamp 100 according to the present embodiment so that it can improve the durability of the semiconductor optical elements 12*a*, 12*b* by reducing unevenness in the cooling of the power supply board 7 and the substrates 11*a*, 11*b*. Also, since the power supply board 7 on which the electronic components 9 for the AC-DC conversion are mounted is contained in the chassis 2, an existing fluorescent lamp can be easily replaced with the lamp 100 at low cost.

Although the present invention has been described in terms of exemplary embodiments, it is not limited thereto. It should be appreciated that variations or modifications may be made in the present embodiments described by persons skilled in the art without departing from the scope of the present invention as defined by the following claims.

What is claimed is:

1. A straight tube LED lamp comprising:

a first substrate and a second substrate on which semiconductor light-emitting elements are arranged in parallel in a longitudinal direction;

a chassis with a semi-circular cross section, made from a metal, and extending in the longitudinal direction, to mount the substrate in a chord portion of the semi-circle;

a first resin sheet interposed between the chassis and the first substrate;

a second resin sheet interposed between the chassis and the second substrate;

a translucent element contacting the chassis to form a circle, made from a resin or a glass through which light beams from the semiconductor light-emitting elements are transmitted, and extending in the longitudinal direction;

cap elements placed to cover both ends of the chassis and the translucent element, and connectable to a lamp fitting; and a power supply board on which an electronic component is mounted, contained in the chassis, the electronic component supplied with an alternating current via terminals of the cap elements to convert the alternating current to a direct current supplied to the semiconductor light-emitting elements; wherein the power supply board is disposed on the first substrate, the first resin sheet is made from a material with a low thermal conductivity, and the second resin sheet is made from a material with a thermal conductivity to have the semiconductor light-emitting elements on the first and second substrates be saturated at similar temperatures.

2. The straight tube LED lamp according to claim 1, wherein a separator having a low thermal conductivity is disposed between the chassis and the power supply board.

3. A lighting device comprising:

the straight tube LED lamp according to claim 1; and a lamp fitting in which the straight tube LED lamp is mounted.

* * * * *